US009050654B2

(12) United States Patent
Asada

(10) Patent No.: US 9,050,654 B2
(45) Date of Patent: Jun. 9, 2015

(54) METHOD OF MANUFACTURING COMPOSITE BALL FOR ELECTRONIC PARTS

(75) Inventor: Ken Asada, Izumi (JP)

(73) Assignee: HITACHI METALS, LTD., Tokyo (JP)

( * ) Notice: Subject to any disclaimer, the term of this patent is extended or adjusted under 35 U.S.C. 154(b) by 348 days.

(21) Appl. No.: 12/708,291

(22) Filed: Feb. 18, 2010

(65) Prior Publication Data

US 2010/0212456 A1 Aug. 26, 2010

(30) Foreign Application Priority Data

Feb. 20, 2009 (JP) ..... 2009-038163
Nov. 27, 2009 (JP) ..... 2009-270777

(51) Int. Cl.
*B22F 1/02* (2006.01)
*B22F 1/00* (2006.01)

(52) U.S. Cl.
CPC ..... *B22F 1/025* (2013.01); *B22F 1/0048* (2013.01); *B22F 1/0081* (2013.01); *B22F 2998/00* (2013.01)

(58) Field of Classification Search
USPC ..... 205/222
See application file for complete search history.

(56) References Cited

U.S. PATENT DOCUMENTS

| | | | | |
|---|---|---|---|---|
| 4,394,558 | A * | 7/1983 | Inoue | 219/69.12 |
| 6,259,159 | B1 * | 7/2001 | Dalal et al. | 257/738 |
| 6,518,667 | B1 * | 2/2003 | Ichida et al. | 257/738 |
| 7,045,050 | B2 * | 5/2006 | Tanaka et al. | 205/143 |
| 2004/0149587 | A1 * | 8/2004 | Hradil | 205/252 |
| 2006/0046620 | A1 * | 3/2006 | Hoffman | 451/32 |
| 2008/0090096 | A1 * | 4/2008 | Suzuki et al. | 428/674 |
| 2008/0206567 | A1 * | 8/2008 | Min et al. | 428/404 |
| 2008/0280029 | A1 * | 11/2008 | Yagi et al. | 427/58 |

FOREIGN PATENT DOCUMENTS

| | | | |
|---|---|---|---|
| JP | 11-074311 | A | 3/1999 |
| JP | 11-092994 | A | 4/1999 |
| JP | 2008-30093 | A | 2/2008 |

OTHER PUBLICATIONS

Mei, Z. et al., "Low-Temperature Solders", Hewlett-Packard Journal, Aug. 1996, pp. 1-10.*

* cited by examiner

*Primary Examiner* — George Wyszomierski
(74) *Attorney, Agent, or Firm* — Sughrue Mion, PLLC

(57) ABSTRACT

Disclosed is a method of manufacturing a composite ball for electronic parts by preparing a core ball with spherical shape, forming a solder-plated layer encompassing the core ball to obtain a composite ball, and then conducting a smoothing work on the surface of the solder-plated layer, therein the smoothing work is preferably conducted by bringing a medium into contact with the surface of the solder-plated layer.

6 Claims, 4 Drawing Sheets

METHOD OF MANUFACTURING COMPOSITE BALL FOR ELECTRONIC PARTS

INCORPORATION BY REFERENCE

The present application claims priorities from JP patent applications Ser. No. 2009-038163 filed on Feb. 20, 2009, Ser. No. 2009-270777 filed on Nov. 27, 2009, the contents of which are hereby incorporated by reference into this application.

TECHNICAL FIELD

The present invention relates to a method of manufacturing a composite ball for electronic parts, having a solder-plated layer, used for a connection terminal or the like of an area array terminal type package represented by BGA (Ball Grid Array).

BACKGROUND OF THE INVENTION

In recent years, there have been ongoing studies on three-dimensional high-density mounting such as package on package (POP) and multi-chip module (MCM) to meet a demand for higher mounting density in electronic parts. When such packages are mounted by BGA with solder balls to increase a density by stacking in the height direction, the solder balls may be unable to withstand the weights of the packages themselves and may collapse. The collapsing of the solder balls may cause short circuit between connection terminals, which is formed by the melting of the solder balls. Thus, it may be hard to achieve the high-density mounting.

In order to solve the above-described problems, JP-A-11-74311 presents to mount with composite balls manufactured from core balls having higher melting point than solder, such as Cu, coated with solder. Having core balls of higher melting point than that of the solder layer prevents the connection terminals from collapsing to the gap height during mounting. Thus, it becomes possible to achieve three-dimensional high-density mounting of the packages.

JP-A-11-74311 presents to manufacture a composite ball by coating the surface of a core ball with solder by plating. The coated layer formed by plating is advantageous in that it is a stable film matching electrically and thermally, suitable for practical use, and providing ease of rolling.

Furthermore, regarding the method of coating the surface of a core ball with solder, JP-A-11-92994 discloses a method of electrolytic plating with horizontally rotatable and hermetically-sealed plating vessel disposed with a cathode in a circumferential part inside the vessel and an anode in the central part inside the vessel, by rotating the vessel at specific high rotational speed. JP-A-11-92994 thereby discloses an improvement to form a solder-plated layer with a uniform thickness without producing cohesion.

BRIEF SUMMARY OF THE INVENTION

The electrolytic plating method disclosed in the above-mentioned JP-A-11-92994 is advantageous in that the solder-plated layer is formed with a uniform film thickness with respect to the core ball. However, even such a plating method may cause nonuniform growth of crystal depending on various conditions such as current density during plating and may produce unevenness on the surface as a consequence.

Since the ball having an uneven surface has difficulty in rolling, the positional accuracy of mounting the ball is reduced. Furthermore, since the unevenness makes it difficult to be detected by images, there is a problem with an image processing apparatus to detect losses after mounting the balls. Furthermore, there is another problem that an organic component caught in the unevenness during formation of bumps is gasified due to the melting during reflow, stays as voids in the coating, and then reducing the bonding reliability, or the ball is misaligned when the gas component is emitted from the coating.

An object of the present invention is to provide a method of manufacturing a composite ball for electronic parts with smooth surface by eliminating unevenness on the surface of the solder-plated layer of the ball.

After studying improvement of surface properties of a composite ball for electronic parts with solder plating, the present inventor discovered that a smoothing work could be applied to the unevenness on the surface of a solder-plated layer, and then attained the present invention.

That is, the present invention provides a method of manufacturing a composite ball for electronic parts including the steps of preparing a core ball with spherical shape, forming a solder-plated layer encompassing the core ball to obtain a composite body, and then conducting a smoothing work on a surface of the solder-plated layer.

Preferably, the smoothing work is conducted by bringing a medium into contact with the surface of the solder-plated layer.

Preferably, the smoothing work is conducted by bringing the composite bodies into contact with each other.

Preferably, the smoothing work is conducted in a liquid in a rotating tank.

More preferably, the liquid is an aqueous solution of pH 4 to 6.

The present invention can suppress unevenness of the surface of the solder-plated layer formed by plating process and is a technique indispensable for practical use as a chip carrier, for example, in a semiconductor package.

DETAILED DESCRIPTION OF THE INVENTION

Figure 1:
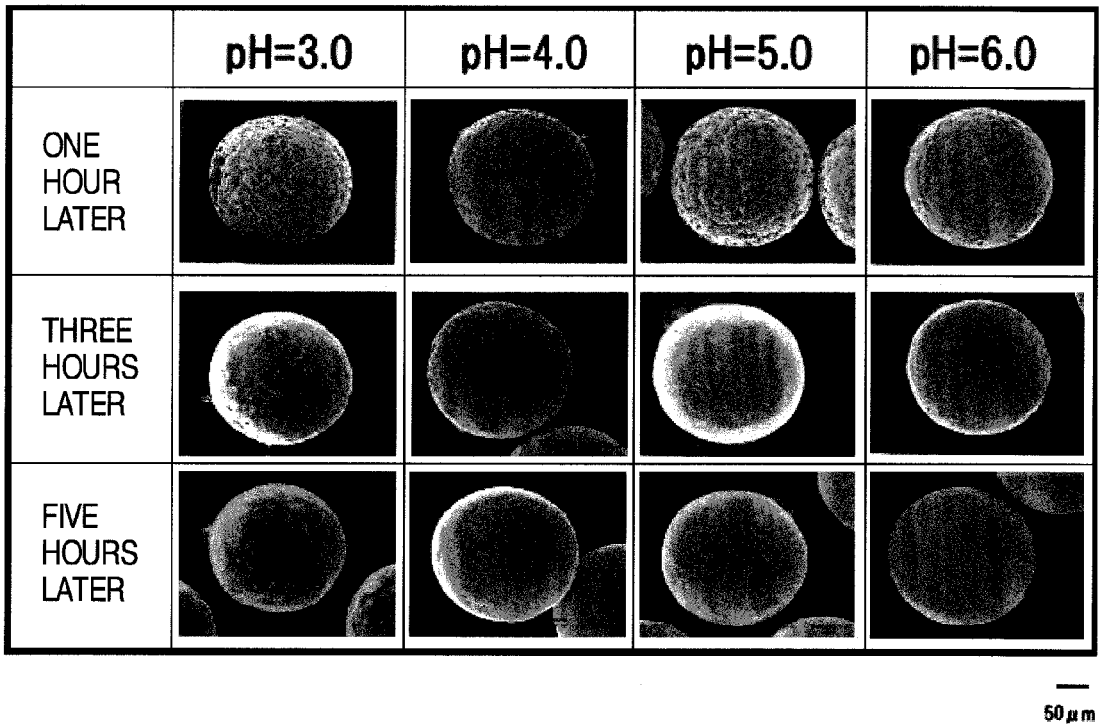
FIG. 1 is a scanning electron micrograph showing an appearance of a composite ball of the present invention.

A key feature of the method of manufacturing a composite ball for electronic parts of the present invention is that a smoothing work is conducted on the surface of the solder-plated layer.

Conventionally, efforts have been focused on improvement of solder plating techniques for a solder-plated layer formed on the surface of composite balls for electronic parts. However, no attempt has been made to reform the surface of the plated layer by different means.

After studying the problem in relation to the surface condition of the solder-plated layer, it is found that a smoothing work can be added in the present invention as post-processing step of solder plating. Actually, the present inventor succeeded in the formation of a smoothed surface.

To the smoothing work of the present invention, it is possible to apply a physical technique of deforming the unevenness on the surface of the solder-plated layer or mechanically removing the unevenness, or a chemical technique of removing the unevenness through acid cleaning or the like.

Simple smoothing work may be conducted by bringing a medium into contact with the surface of the solder-plated layer. The "medium" is a medium such as abrasives. The uneven surface can be deformed or physically removed and then the smooth surface can be obtained by adding physical stress to the surface of the solder-plated layer through contact between the medium and the solder-plated layer. Massive grinding stone or molded grinding stone may be used as the material of the medium as well as grinding stone of organic matter or the like. The material, shape and amount of the medium may be appropriately selected according to the material, shape, quantity or required finished condition of the surface of a composite body to be processed.

In the present invention, it is not essential to use the above-described medium. The smoothing work may be conducted by bringing the composite bodies into contact with each other. In this case, the composite body acts as the medium. This provides an advantage of preventing impurities from adhering to the surface or from being pushed into the surface during the smoothing work, which is a problem originating from the medium.

It may be appropriately selected whether to use the medium or to rely on only contact between the composite bodies, in the light of the action of the medium such as the grinding force added by the medium, and the above-described problem of the adherence of impurities.

In the smoothing work of the present invention, it is possible to add physical stress to the surface of the solder-plated layer by causing the flow of the composite bodies or the composite bodies and the added medium through agitation or the like. Thereby, the uneven surface can be deformed by a frictional force of the composite bodies and medium, then smooth surface of the solder-plated layer can be obtained. Here, to cause the flow of the composite bodies and medium, it is possible to use a method of agitating the composite bodies and medium in a container (tank) using an agitating rod or a method of rotating a container (tank).

The use of the rotary tank is preferable to conduct the smoothing work uniformly, since it promotes the flow of the composite body with the solder-plated layer, and increases the chances of contact between the composite bodies, or between the composite bodies and the container wall surface of the rotary tank or the added medium or the like.

Furthermore, the smoothing work may be conducted in the liquid. This causes to reduce excessive friction between the composite bodies, or between the composite bodies and the container wall surface of the rotary tank or the added medium or the like, and then a more accurate and smoother surface can be obtained. There is also an effect to suppress the re-attachment of grinded substances removed through grinding.

As for the type of the liquid used in the smoothing work in the liquid, a reductive type that prevents oxidation or a soluble type that lightly dissolves the solder-plated layer and promotes the smoothing work may be selected. Specifically, while deionized water may be used, it is more efficient to use an acidic aqueous solution having pH 4 to 6. It can be expected that the acidic aqueous solution has the advantage to remove grinded substances produced by the smoothing of the plating layer and impurities originating from the medium. Examples of the preferable acidic solution include sulfonic acid-based (methanesulfonic acid or the like) and carboxylic acid-based (oxalic acid or the like) solution.

Furthermore, as for the liquid to be used, the plating solution used to form the plating layer may be used as is without applying any voltage when a solder-plated layer is formed by an electrolytic plating method. Furthermore, the properties of the liquid may be adjusted by adding a complexing agent or surfactant or the like depending on the conditions.

The diameter of the core ball handled in the present invention is typically 50 to 1500 μm. This is because core balls exceeding 1500 μm in size are not used much for electronic parts and core balls smaller than 50 μm in size are not used much from the standpoint of handling performance.

As for the material of the core ball for electronic parts, when a good conductor are required for the core ball, metal such as Cu, Ni, Fe, or Co as a single unit or an alloy thereof may be selected. Otherwise, a spherical body of ceramics or resin may be adopted.

Furthermore, the thickness of the solder-plated layer is typically 0.01 to 50 μm. The thickness may be appropriately selected based on the characteristics required as solder.

A typical solder composition as the electronic parts is Sn—Bi, Sn, Sn—Ag, Sn—Ag—Cu, and Sn—Au, and those having melting point of 300° C. or below are normally used.

As for the method of forming a solder-plated layer, an electrolytic plating method, non-electrolytic plating method, hot-dip plating method, or the like may be appropriately selected.

In the present invention, the smoothing work for the solder-plated layer is important. Thus, another layer may exist between the solder-plated layer and the core ball. A typical example is a Ni barrier layer or the like formed for the purpose of preventing diffusion of the Cu core ball by solder when Cu is used for the core ball.

In the present invention, to use the apparatus is preferable which conducts smoothing work in the liquid in the rotary tank as described above. A vertical drum type, horizontal drum type, inclined drum type, or the like may be appropriately selected as the rotary tank.

Since no flow is caused by gravity in the horizontal drum type, it is preferable that the operations such as stoppage, inversion, and variable speed are taken in the rotational operation of the drum so that the smoothing work proceeds uniformly. Such an operating condition of the rotary tank may be appropriately selected according to the size of the rotary tank, and the size and amount of the composite body to be processed.

Furthermore, when solder plating is conducted in the rotary tank, it is also possible to conduct the smoothing work without a break after the plating process by rotating the rotary tank without applying any voltage after completion of plating process. The surface of the composite ball for electronic parts obtained by the present invention can be set to Rz of 5 μm or less, Ra of 2 μm or less according to JIS B0601 measurement.

Example 1

First, 670,000 core balls with spherical shape were prepared, which was manufactured from Cu balls of 200 μm in diameter by plating with Ni of 2 μm in thickness to be served as a base layer on the surface of the Cu balls. A methanesulfonic acid plating solution (pH 4) containing 22 g/L Sn and 1 g/L Ag was prepared as the plating solution. As for the plating apparatus, a barrel plating apparatus was used which had a rotary tank rotatable in the vertical direction around the horizontal axis and having the shape of a hexagonal column with a diagonal length of 60 mm and a width of 110 mm. The rotary tank was immersed in the plating solution and a solder-plated layer was formed with the barrel plating apparatus. The plating condition was that the rotational speed of the rotary tank was set to 80 rpm and the current density was set to 0.15 $A/dm^2$. Electric plating was performed for six hours only in one rotational direction. As a result, a Sn-3% Ag (mass %) solder-plated layer having a thickness of 25 μm was formed and a composite body was obtained.

Figure 5A:
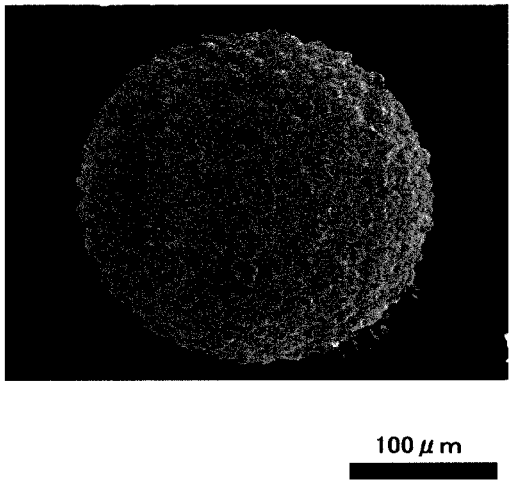
FIG. 5A is a scanning electron micrograph showing an appearance of a composite body before smoothing work.
Figure 5B:
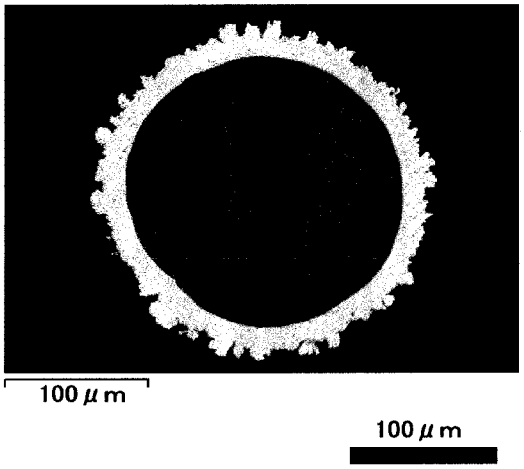
FIG. 5B is a scanning electron micrograph showing a cross sectional view of a composite body before smoothing work.

FIGS. 5A and 5B are scanning electron micrographs showing the appearance and cross sectional view of the composite body with the solder-plated layer before smoothing work. As shown in FIGS. 5A and 5B, the uneven surface of the composite body was formed.

Next, all the composite bodies obtained were transferred into a cylindrical rotary tank having an inner diameter of 280 mm and a height of 40 mm, which is horizontally rotatable around a vertical axis. Subsequently, the amount of 4 L of methanesulfonic acid plating solution containing 22 g/L Sn and 1 g/L Ag with pH of the liquid adjusted to 3.0, 4.0, 5.0, or 6.0 was added. Then, the rotary tank was rotated at the rotational speed of 500 rpm, with alternate rotational direction of forward and backward at intervals of 10 seconds, for one, three, or five hours. The smoothing work was conducted by bringing the composite bodies into contact with each other without using a medium. Thereby, composite balls for electronic parts were obtained.

FIG. 1 is a scanning electron micrograph showing an appearance of a composite ball for electronic parts of the present invention with the smoothing work conducted on the surface of the solder-plated layer. A pattern of indefinite forms in the figure observed other than the composite balls for electronic parts are foreign matters trapped therein during the observation and has directly nothing to do with the composite balls for electronic parts of the present invention. As shown in FIG. 1, it was confirmed with any plating solution adjusted to different pH values that the surface of the solder-plated layer became smooth after conducting the smoothing work for one hour, compared to the composite body with no smoothing work shown in FIGS. 5A and 5B.

Furthermore, it was confirmed that conducting the smoothing work for three hours could make the surface of the solder-plated layer smoother. Furthermore, it was confirmed that conducting the smoothing work for five hours could cause a substantially perfect spherical shape, and the balls were obtained suitable for the composite ball for electronic parts used in a semiconductor package or the like. Furthermore, it was also confirmed that the surface of the solder-plated layer could be smoothed in a shorter time as pH increased.

Figure 2A:
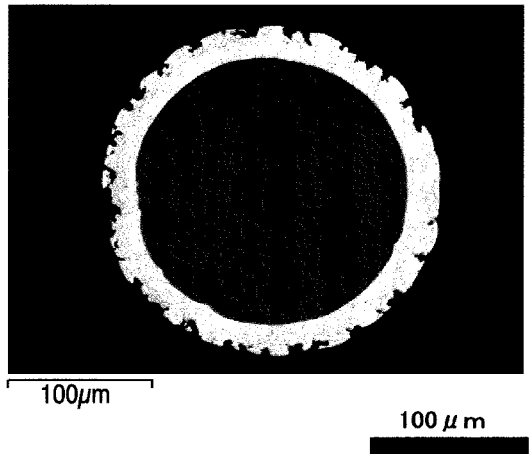
FIG. 2A is another scanning electron micrograph showing a cross sectional view of the composite ball of the present invention after process for one hour.
Figure 2B:
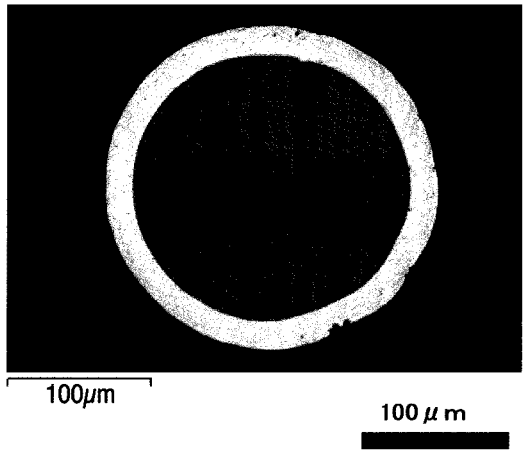
FIG. 2B is another scanning electron micrograph showing a cross sectional view of the composite ball of the present invention after process for three hours.
Figure 2C:
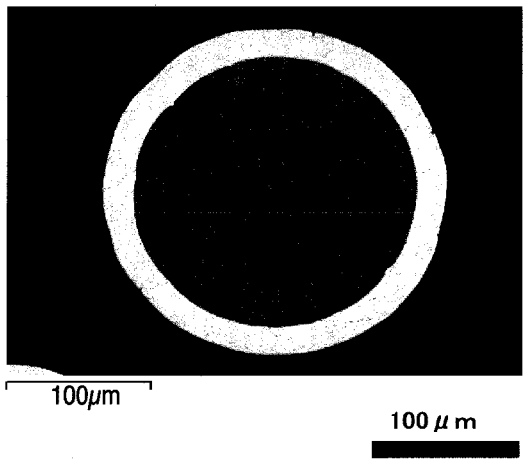
FIG. 2C is another scanning electron micrograph showing a cross sectional view of the composite ball of the present invention after process for five hours.

FIGS. 2A to 2C are scanning electron micrographs showing cross sectional views of the composite balls for electronic parts obtained by the above, which were conducted with the smoothing work in the methanesulfonic acid plating solution adjusted to pH 4.0 for one, three, or five hours. As shown in FIG. 2A, it was also confirmed from the cross sectional view that the surface of the solder-plated layer became smooth after conducting the smoothing work for one hour, compared to the composite body with no smoothing work shown in FIGS. 5A and 5B.

Furthermore, as shown in FIG. 2B, conducting the smoothing work for three hours could make the surface of the solder-plated layer smoother. As shown in FIG. 2C, conducting the smoothing work for five hours could cause a substantially perfect spherical shape.

Next, the surface roughness of the five composite balls for electronic parts which were extracted arbitrarily were measured using a laser microscope (VK-9700) manufactured by KEYENCE CORPORATION. The measured were the surface area within the 100×100 μm measuring size and the arithmetic average roughness Ra defined in JIS B0601 (2001). Table 1 shows the measuring results. The composite body before smoothing work had Ra of 1.805 μm. However, as for the composite balls for electronic parts after the smoothing work according to the present invention, it was confirmed that the effect of the smoothing work was increased as the processing time went on and the pH was increased. It was confirmed that a smooth surface could be obtained after the smoothing work for five hours, especially at pH 4.0 to 6.0.

TABLE 1

| | Processing liquid pH | | | | | | | |
|---|---|---|---|---|---|---|---|---|
| Processing | 3.0 | | 4.0 | | 5.0 | | 6.0 | |
| time Hr | Surface area $\mu m^2$ | Ra μm | Surface area $\mu m^2$ | Ra μm | Surface area $\mu m^2$ | Ra μm | Surface area $\mu m^2$ | Ra μm |
| 1 | 17745 | 1.212 | 14993 | 0.992 | 14551 | 0.734 | 13226 | 0.688 |
| 3 | 16737 | 1.193 | 11705 | 0.337 | 11300 | 0.244 | 11202 | 0.222 |
| 5 | 13045 | 0.665 | 11364 | 0.237 | 11145 | 0.226 | 11118 | 0.219 |

Example 2

All the composite bodies obtained with the same condition as Example 1 were transferred into the same cylindrical rotary tank as Example 1, which was horizontally rotatable around the vertical axis. Subsequently, the amount of 4 L of deionized water (pH 7) was added. Then, the rotary tank was rotated at the rotational speed of 500 rpm, with alternate rotational direction of forward and backward at intervals of 10 seconds, for five hours. The smoothing work was conducted by bringing the composite bodies into contact with each other without using a medium. Thereby, composite balls for electronic parts were obtained.

Figure 3:
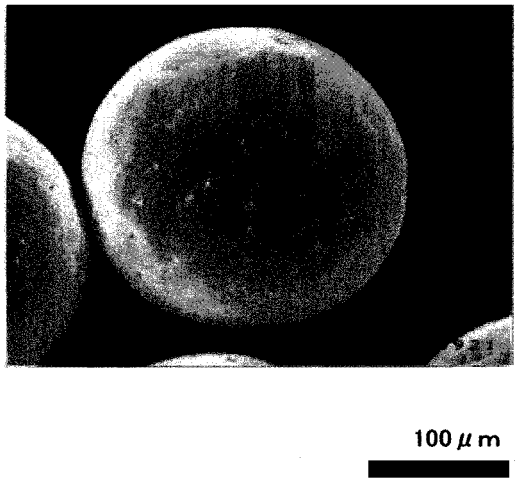
FIG. 3 is another scanning electron micrograph showing an appearance of a composite ball of the present invention.

FIG. 3 is a scanning electron micrograph showing an appearance of the composite balls for electronic parts of the present invention with the smoothing work conducted on the surface of the solder-plated layer. As shown in FIG. 3, it was confirmed the smooth surface was obtained which was equivalent to the surface of the composite balls for electronic parts obtained in Example 1, even though the smoothing work for composite balls for electronic parts of the present invention was conducted in the deionized water. It was also confirmed that the surface of the solder-plated layer became smooth, compared to the composite body with no smoothing work shown in FIGS. 5A and 5B.

Next, the surface roughness of the five composite balls for electronic parts which were extracted arbitrarily were measured using a laser microscope (VK-9700) manufactured by KEYENCE CORPORATION. The maximum height Rz defined in JIS B0601 (2001) was measured at arbitrary five points with 25×25 μm measuring size.

The results showed that, as for the comparative example of the composite body before the smoothing work, the maximum height Rz of five balls were 7.89 μm as a maximum value, 3.96 μm as a minimum value and 5.92 μm as an average value. On the other hand, as for the composite balls for electronic parts with the five hours smoothing work in the example of the present invention, the maximum height Rz of five balls were 3.35 μm as a maximum value, 1.06 μm as a minimum value and 1.93 μm as an average value. Therefore, it was confirmed that the surface of the solder-plated layer became smoother and the balls were obtained suitable for the composite balls for electronic parts used in a semiconductor package or the like.

Example 3

All the composite bodies obtained with the same condition as Example 1 were transferred into the same cylindrical rotary tank as Example 1, which was horizontally rotatable around the vertical axis. Then, 58,000 (25 g) Cu balls with a diameter of 450 μm were added in the tank as media. Subsequently, the amount of 4 L of methanesulfonic acid plating solution containing 22 g/L Sn and 1 g/L Ag was added. Then, the rotary tank was rotated for the smoothing work at the rotational speed of 500 rpm, with alternate rotational direction of forward and backward at intervals of 10 seconds, for five hours. Thereby, composite balls for electronic parts were obtained.

Figure 4:
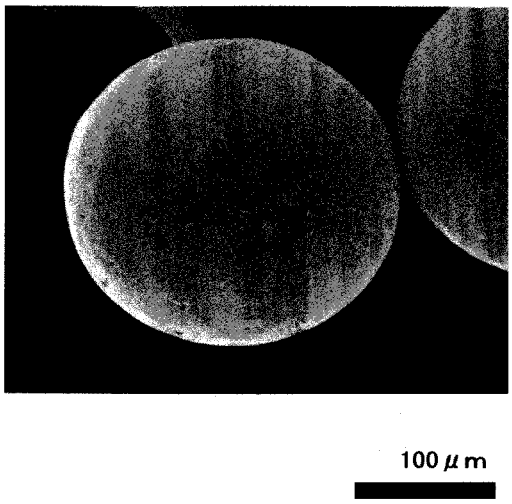
FIG. 4 is another scanning electron micrograph showing an appearance of a composite ball of the present invention.

FIG. 4 is a scanning electron micrograph showing an appearance of composite balls for electronic parts of the present invention with the smoothing work conducted on the surface of the solder-plated layer. As shown in FIG. 4, it was confirmed that by the smoothing work with the media charged therein, the surface was obtained which was equivalent to the surface after the smoothing work for the same duration without charging the media obtained in Example 1, as shown in FIG. 1. Thereby, the balls were obtained suitable for the composite balls for electronic parts used in a semiconductor package or the like.

The invention claimed is:

1. A method of manufacturing a composite ball for electronic parts, comprising the steps of:

preparing a core ball with spherical shape;

forming a solder-plated layer encompassing the core ball to obtain a composite body; and then conducting a smoothing work on an uneven surface of the solder-plated layer after plating, wherein the smoothing work is conducted by bringing composite bodies into contact with each other in a rotated rotary tank containing an acidic plating solution.

2. The method according to claim 1, wherein the smoothing work is conducted by further bringing a medium into contact with the surface of the solder-plated layer.

3. The method according to claim 2, wherein the medium is Cu balls.

4. The method according to claim 1, wherein the acidic plating solution is an aqueous solution of pH 4 to 6.

5. The method according to claim 2, wherein the acidic plating solution is an aqueous solution of pH 4 to 6.

6. The method according to claim 3, wherein the acidic plating solution is an aqueous solution of pH 4 to 6.

* * * * *